United States Patent [19]

Prudhon et al.

[11] 4,379,638

[45] Apr. 12, 1983

[54] DEVICE FOR PUTTING INTO CONTACT SUBSTANCES EXISTING IN AT LEAST TWO DIFFERENT PHASES

[75] Inventors: Francois J. Prudhon, Versailles; Augustin L. Scicluna, Aubervilliers, both of France

[73] Assignee: Rhone-Poulenc Industries, Paris, France

[21] Appl. No.: 252,358

[22] Filed: Apr. 9, 1981

Related U.S. Application Data

[63] Continuation of Ser. No. 19,362, Mar. 12, 1979, abandoned.

[30] Foreign Application Priority Data

Mar. 14, 1978 [FR] France ..... 78 07248

[51] Int. Cl.[3] ..... B01F 5/00; B01F 15/06; B01F 15/02

[52] U.S. Cl. ..... 366/149; 261/79 A; 366/150; 366/165; 366/178

[58] Field of Search ..... 366/150, 165, 178, 177, 366/181, 144, 149, 148, 167, 172; 261/79 A

[56] References Cited

U.S. PATENT DOCUMENTS

| | | | |
|---|---|---|---|
| 2,724,580 | 11/1955 | Revallier | 366/165 |
| 2,847,083 | 8/1958 | Hibshman | 261/79 A |
| 3,284,169 | 11/1966 | Kenichi | 261/79 A |
| 3,406,953 | 10/1968 | Moore | 261/79 A |
| 3,741,533 | 6/1973 | Winn | 366/178 |
| 3,946,993 | 3/1976 | Morlin | 366/150 |
| 3,994,480 | 11/1976 | Fothergill | 366/165 |

*Primary Examiner*—Robert W. Jenkins
*Attorney, Agent, or Firm*—McDougall, Hersh & Scott

[57] ABSTRACT

A device for putting into contact substances existing in at least two different phases, one of which is a gaseous phase introduced into a cylindrical section for helicoidal flow, a divider extending axially through the cylindrical section having openings for passage of the helicoidal streams therethrough to a bicone, an axial passage for introduction of the other phase into the path for engagement by the helicoidal streams for copulverization.

5 Claims, 4 Drawing Figures

DEVICE FOR PUTTING INTO CONTACT SUBSTANCES EXISTING IN AT LEAST TWO DIFFERENT PHASES

This is a continuation, of application Ser. No. 19,362, filed Mar. 12, 1979, now abandoned.

The present invention pertains to a device which allows for substances existing in at least two different phases to be put into contact.

French Pat. No. 2 257 326 describes a process for putting into contact substances existing in two different phases; it consists of the formation of a symmetric swirling-well flow with the introduction of at least one phase according to the axis of revolution up to the depression zone caused by the swirling-well flow, the velocity of the axial phase being between 0.03 and 3 m/s, and the momentum of the swirling-well flow phase being at least 100 (and preferably 1000 to 10,000) times that of the axial phase, so that the axial phase is disintegrated and dispersed by the swirling-well flow phase.

The great advantage of this process is that it permits the formation of an organized dispersion; in the techniques of prior art, the contact established between both phases is of the aleatory, therefore irregular type and leads to detrimental differences in treatment as much as from the thermal point of view as from the chemical point of view.

To implement this process, French Pat. No. 2 257 326 describes a design of the device consisting of an at least partly cylindrical outer jacket with a limited part located downstream, equipped internally with a perforated liner, defining between said jacket and perforated liner an annulus into which flows at least one tangential inlet so as to cause symmetric flow of the swirling-well type.

However, although such a device especially allows for an adequately stable symmetric flow, it is in particular limited when working at high temperatures is required.

To alleviate these drawbacks, using refractory materials or using double jacket systems with liquid flow was considered.

But with these, problems of thermal inertia, abrasion with certain materials and thermal shock are encountered. Moreover, the system's geometry is incompatible when extra thicknesses are used.

Furthermore, in the device, the gas divider which provides for the symmetric flow, performs a mechanical function by helping to ensure the rigidity of the assembly. Consequently, it is difficult to cool it simply and efficiently.

Finally, it is advantageous to be able to obtain the greatest angular momentum possible in order to have high peripheral velocities.

The purpose of the present invention is precisely to alleviate these drawbacks. It pertains to a new device for putting into contact substances existing in different phases, and consists of at least one element of revolution in form of a cylindrical housing 14 with a limited passage 5' at its downstream part and at least one axial pipe 9 opening out at the level of the limited passage 5' spaced at a distance more or less equal to the radius of the limited passage, and a divider element 3 of revolution with respect to the same symmetry axis as the axial pipe, and at least one tangential supply means 8 in the space defined by the element of revolution with limited passage, and is characterized by the fact that the element of revolution with limited passage is made up of a continuous rigid element with axial symmetry defining a space of revolution which is closed except at its downstream part, and divided in two by the divider, which is mechanically independent of said rigid element.

Advantageously, the divider 3 is secant to the rigid divider element on its wall nearest to the symmetry axis of rotation of the system.

Advantageously, in the present invention, the rigid jacket 13 is made up of a double walled body 1, 2 with symmetry of revolution, so as to provide an annulus where the tangential inlet or inlets 8 open out, and an axial cavity where a pipe with axial symmetry, such as a cylindrical tube or truncated cone, is set, said pipe opening out at the level of the downstream opening 5' of the rigid jacket, more or less equal distance to the radius of said opening.

Preferably, the section of the defined annulus decreases in the direction of flow of the phase introduced tangentially, said phase is generally formed of a gas, possibly charged.

For purposes of simplicity, the downstream part of the rigid jacket appears as two coaxial, convergent, concentric truncated cones 6–7 set around the supply pipe 9 of the axial phase, and the perforated divider 3 is composed of a cylinder of revolution secant to at least one of the cones.

For practicality, this divider 3 can be mounted so as to be detachable.

The arrangement of the elements of the invention, namely:

- axial supply tubulures 8 for solid, liquid or semi-liquid phases,
- annulus 6–7 with limited opening 5' at its end,
- and secant and detachable divider 3, translates into the configuration which allows for:
- an increase in initial angular momentum, therefore peripheral ejection velocity,
- simple cooling of the walls by a circulating liquid.

The first condition can be met by using a double wall with a simple geometric shape of revolution enclosing a space of revolution, toric, for example, extended downstream by a space of revolution for gas flow obtained by a double truncated cone, these two parts of the device actually being separated by the divider element of revolution itself with respect to the same symmetry axis as the annulus.

The second condition is met by equipping with a classical cooling system such as the circulation of a cooling liquid such as water around the outer part of the double jacket, the divider element not needing to be cooled.

As stated above, this new device allows for the process claimed in French Pat. No. 2 257 326 to be implemented, with formation of pulverization droplets by transfer of momentum.

It can also provide for the introduction of several phases coaxially and several helicoidal phases; in each case, the contactor-reactor in the invention can be considered as a piston if the evolution of the system is considered from the point of view of concentration and homogeneous as far as temperatures are concerned.

One advantage of the device in the present invention resides in the fact that it makes it possible to increase the demi-angle at the top of the asymptotic cone of the hyperboloid to a nappe constituted by all the trajectories from the helicoidal phase carrying the elements of volume of the axial phase.

A great number of applications can be achieved with the device in the invention, for example, rapid evaporation of volatilizable compounds, drying of products in suspension or in aqueous emulsion, concentration of solutions . . . .

As described in French Pat. No. 2 257 326, dry blend operations can also be carried out, setting of particles with transformation into fine balls with possibly a modification in the surface structure of the grains. Classical chemical reactions, such as those carried out in a reactor or atomizer, can also be carried out. Thus, direct carbonation by soda treatment with a gas containing carbonic gas can be carried out advantageously.

The treatment of heat sensitive materials as described in French application No. 77 20287 of July 1, 1977 constitutes still another field of application.

This device can also be used in combination with a Venturi at the outlet, in the heat treatment of a gaseous phase as described in French application No. 77 29002 of Sept. 27, 1977 now French Pat. No. 2,404,173.

The axial phase is generally made up of a liquid phase, but it can be charged, or even semi-liquid or pastey.

In particular, two liquid or semi-liquid axial phases can be introduced and their contact achieved by swirling-well flow. Co-pulverization is thus achieved.

In this case, the helicoidal phase may be active or not from the point of view of chemistry. Such an application can be especially interesting in the case of simultaneous reactions such as, for example, the co-precipitation of a latex solution and a silica as described in French application No. 76 35883 filed Nov. 29, 1976 corresponding to U.S. Pat. No. 4,185,001, in the name of the applicant.

A particularly interesting application of the present invention resides in the solution it brings to the problems of the treatment of waste waters and pollution.

French application 77 31554 of Oct. 20, 1977 now French Pat. No. 2,406,610, already claims the application of the general process to the treatment of waste water with simultaneous pulverization and oxidizing treatment.

The device in the invention obviously applies in this case.

However, in the case of depollution, notably, to attain adequate efficiency, work must be carried out at very high temperatures, and this was not possible with the classical devices manufactured up to now.

One of the advantages of the present invention is thus to answer this need felt for such a long time.

The present invention will be more easily understood with the examples of design given for illustrative and non limiting purposes and which are illustrated in the attached figures.

Figure 1:
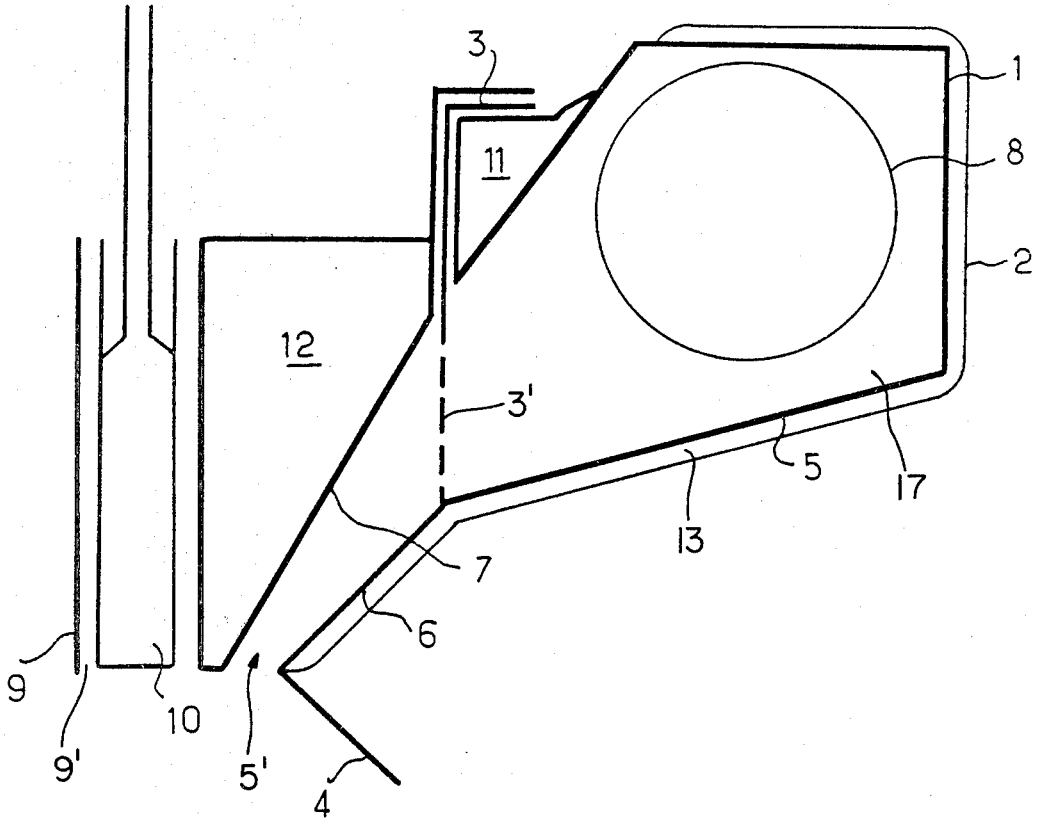
FIG. 1 is a cross-section of a device according to the invention showing only half the section.

In FIG. 1, the rigid element containing the helicoidal phase is composed of rigid double jacket 1 and 2, extended downstream by a bicone, represented here only by the most upstream part 4.

This continuous jacket has in its most upstream part a large annular cavity extended by an annulus defined by the two truncated cones 6 and 7 converging downstream.

The supply of the helicoidal phase is ensured through tangential pipe 8.

The formation of the symmetric helicoidal flow is ensured by divider 3 which is detachable from and mechanically independent of rigid element 1.

In addition, two other cooling jackets 12 are provided between cone 7 and pipe 9, and 11.

The axial phase is brought in through tubular pipe 9; according to this form of design, there is rod 10 provided inside pipe 9.

The device in FIG. 1 has an over-all diameter of 1210 mm; the divider cylinder has 5 rows of orifices from 36 $\phi$ 20.

With an air flow rate of 10 to 11 t/h at 800°–900° C., the velocity at the level of the holes is approximately 100–120 m/s.

Figure 2:
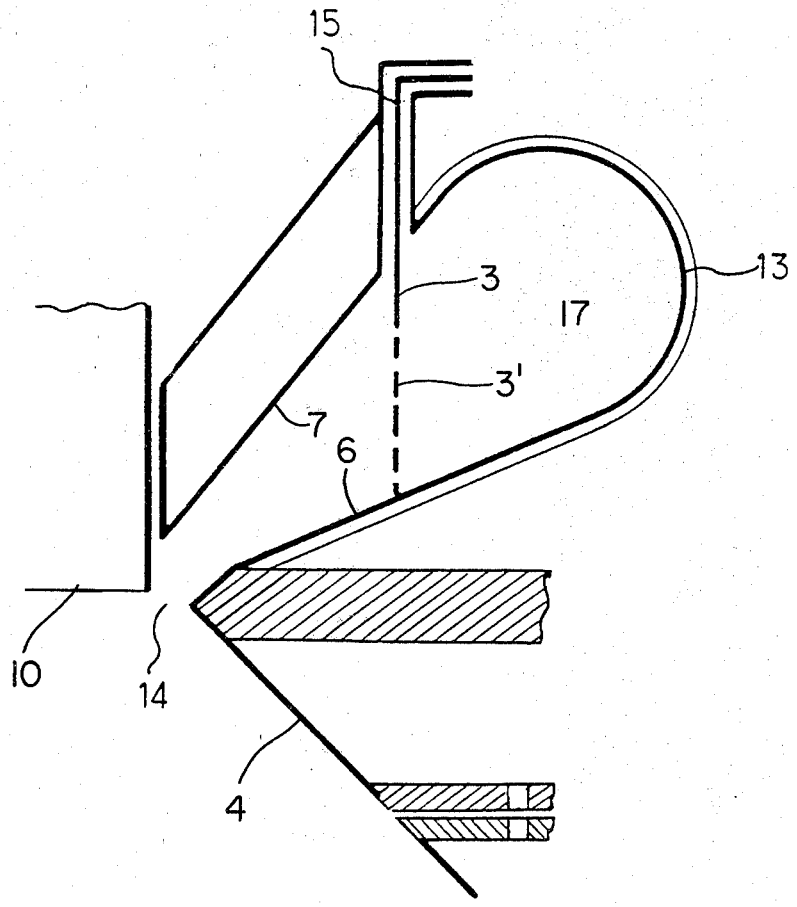
FIG. 2 represents another form of design.
Figure 3:
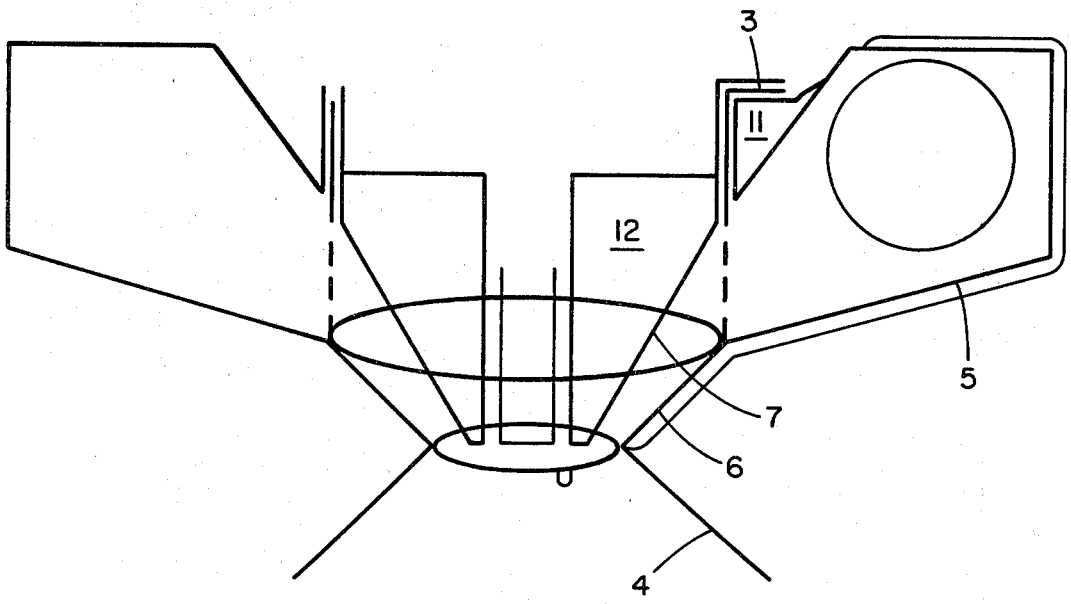
FIG. 3 is a cross section of the device, which includes the other half of the half section of FIG. 1 except for the exchanger.
Figure 4:
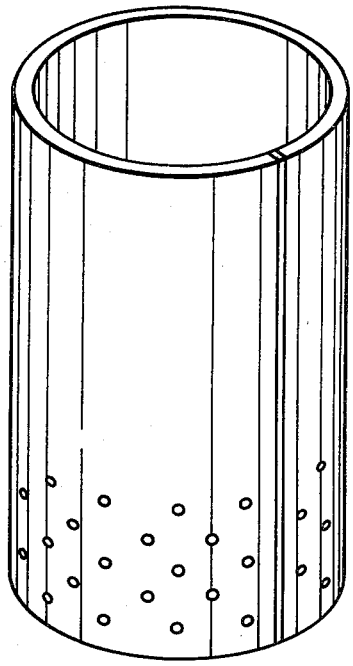
FIG. 4 is a perspective view of the cylindrical dividing member 3.

FIG. 2 represents another form of design according to which the rigid element is made up of jacket 13 open only at its downstream part 14 made up of a continuous curve and cut by divider element 15.

Another interesting application of the present invention is the drying of crystalline alkaline silico-aluminates, notably of type 4A.

According to this application, the suspension to be dried is introduced axially through pipe 9 and the drying air tangentially through pipe 9 at temperatures reaching several hundreds of degrees, approximately 500° to 700° C., this range in no way being limited.

The silico-aluminate suspension can be prepared by any known means; in particular, the processes in FR 77 16991* now French Pat. No. 2,392,932, corresponding to U.S. application Ser. No. 911,951 , now abandoned or FR 76 39527 and 77 08932 now French Pat. No. 2,384,716, corresponding to U.S. application Ser. No. 802,902, now abandoned may be used.

*our R 2490
**our R 2431/R 2431 Al

In operation, the helical phase is introduced through the tangential inlet from supply pipe 8 for helicoidal flow through the circular housing 17 to the restricted outlet opening 5', defined by the two truncated cones 4 and 6, which define divergent conical sections. The formation of the helicoidal phase in symmetrical helicoidal flow is enhanced by the cylindrical divider 3, which defines an element of revolution with respect to the symmetry axis of the axial pipe 9, and is provided with orifices 3 through which the helicoidal stream flows. The liquid or semi-liquid is introduced through the tubular pipe 9 for axial flow through the annular space 9' about rod 10 to the outlet opening at the level of the limited passage.

A heat exchange liquid is circulated through the double jacket formed by walls 1–2 to cool the walls of the element of revolution through which the helicoidal phase is circulated. This represents a conventional cooling system through which a cooling liquid such as water is circulated about the outer part of the double jacket.

When the axial liquid or semi-liquid phase is contacted by the helicoidal gaseous phase at the outlets, copulverization is achieved.

We claim:

1. A device for putting into contact substances existing in different phases, at least one of which is a fluid or gaseous phase comprising a housing of circular cross section, an inlet adjacent the outer periphery of the housing for introduction of the fluid or gaseous phase tangentially into the housing for helicoidal flow therein, an axial outlet opening at the center of the housing, said housing having a converging section extending inwardly to said outlet opening, a divergent section extending from the outlet opening to define a bicone between said converging and diverging sections which define a restricted axial passage at the outlet, at least one axial pipe, the outlet of which is at the level of the restricted passage through which at least one of the other phases is introduced for issuance at the restricted passage to be engaged by the helicoidal flow at about the restricted passage, and a cylindrical dividing member which extends axially through the housing intermediate the inlet and outlet, having passages therein for enabling the helicoidal flow of the one phase for enabling passage of the helicoidal flow of the one phase therethrough from the inlet to the outlet.

2. A device as claimed in claim 1 which includes a double walled jacket about the housing for circulation of a heat exchange fluid therethrough.

3. A device as claimed in claim 1 which includes a rod extending axially to the outlet opening and dimensioned to correspond more or less to the radius of the opening.

4. A device as claimed in claim 1 in which the cylindrical dividing member is detachably mounted in the housing.

5. A device as claimed in claim 1 which includes a venturi coupled with the outlet.

* * * * *

UNITED STATES PATENT OFFICE

CERTIFICATE OF CORRECTION

Patent No. 4,379,638 Dated April 12, 1983

Inventor(s) Francois J. PRUDHON and Augustin L. SCICLUNA

It is certified that error appears in the above-identified patent and that said Letters Patent are hereby corrected as shown below:

In column 3, line 15, after "1977", insert -- now French Patent No. 2,396,250 corresponding to United States application Serial No. 19,584, now U.S. Patent No. 4,265,702, which is a continuation of Serial No. 921,073 (abandoned) --.

In column 4, line 30, change "9" to -- 8 --.

In column 4, line 36, after "application", insert -- Serial No. 86,128, now U.S. Patent No. 4,263,266, which is a continuation of --.

In column 4, line 39, delete "802,902" and insert -- 862,962 --.

Signed and Sealed this

Fifth Day of July 1983

[SEAL]

Attest:

GERALD J. MOSSINGHOFF

Attesting Officer

Commissioner of Patents and Trademarks